US011006218B2

(12) United States Patent
Yanagisawa et al.

(10) Patent No.: US 11,006,218 B2
(45) Date of Patent: May 11, 2021

(54) AUDIO EQUIPMENT, AND SUPPORT FOR AUDIO EQUIPMENT

(71) Applicant: YAMAHA CORPORATION, Hamamatsu (JP)

(72) Inventors: Sho Yanagisawa, Shizuoka (JP); Kiyohiko Goto, Iwata (JP); Taro Morii, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/547,773

(22) Filed: Aug. 22, 2019

(65) Prior Publication Data

US 2020/0068312 A1 Feb. 27, 2020

(30) Foreign Application Priority Data

Aug. 24, 2018 (JP) ..... JP2018-157494

(51) Int. Cl.
*H04R 7/12* (2006.01)
*H04R 1/02* (2006.01)

(52) U.S. Cl.
CPC ..... *H04R 7/12* (2013.01); *H04R 1/02* (2013.01)

(58) Field of Classification Search
CPC ..... Y10T 24/301; Y10T 24/302; H04R 1/02; H04R 1/025; H04R 2499/11; H04R 1/028; H04R 31/006
USPC ..... 248/547, 690; 403/7; 381/368, 361, 386, 381/395
See application file for complete search history.

(56) References Cited

U.S. PATENT DOCUMENTS 4,143,495 A * 3/1979 Hintz ..... E01F 8/007 181/290
2003/0218957 A1* 11/2003 Tanishima ..... F16M 7/00 720/600
2010/0040254 A1* 2/2010 Wright ..... H04R 1/02 381/395
2012/0177232 A1* 7/2012 Katz ..... F21V 21/04 381/152
2017/0188122 A1* 6/2017 Moro ..... H04R 1/026

FOREIGN PATENT DOCUMENTS

JP 2012023538 A 2/2012

* cited by examiner

*Primary Examiner* — Alexander Krzystan
*Assistant Examiner* — Julie X Dang
(74) *Attorney, Agent, or Firm* — Rossi, Kimms & McDowell LLP

(57) ABSTRACT

An audio equipment support include; a main body including a protrusion and being configured to be attachable to an audio equipment housing; a counterpart body including an outer edge and a recess contacting the protrusion, the outer edge of the counterpart body being positioned inward of an outer edge of the main body when viewed from a direction in which the protrusion and the recess are aligned; and a restriction member fixed to the main body and spaced apart from the counterpart body, the restriction member including a through-hole through which the counterpart body passes and being configured to restrict a distance between the main body and the counterpart body from reaching or exceeding a predetermined length.

20 Claims, 5 Drawing Sheets

AUDIO EQUIPMENT, AND SUPPORT FOR AUDIO EQUIPMENT

CROSS REFERENCE TO RELATED APPLICATIONS

This application is based on and claims priority from Japanese Patent Application No. 2018-157494, which was filed on Aug. 24, 2018, and its entire contents are incorporated herein by reference.

BACKGROUND

Technical Field

The present disclosure relates to a support for audio equipment and to audio equipment.

Background Information

There is known in the art a variety of supports for audio equipment, i.e., a device that is used to support audio equipment. In the case of a support for a housing of audio equipment such as audio amplifiers and speakers, the housing of the audio equipment is supported by positioning the support between the housing and a mounting surface. For example, as is disclosed in Japanese Patent Application Laid-Open Publication No. 2012-23538 (hereafter, JP 2012-23538), a support for audio equipment includes a main body and a counterpart body. The main body is attached to the housing, and the counterpart body is positioned between the main body and a mounting surface. The main body includes a protrusion referred to as a spike. The spike is brought into contact at a single point with the counterpart body, and as a result transmission of vibration between the main body and the counterpart body is suppressed. In the configuration described in JP 2012-23538, a member that is fixed to the counterpart body restricts a distance between the main body and the counterpart body from exceeding a predetermined range. As a result of this restriction, the counterpart body is prevented from becoming detached during carriage of the audio equipment support.

SUMMARY

In the configuration described in JP 2012-23538, the member that restricts the distance between the main body and the counterpart body from exceeding a predetermined range is fixed to the counterpart body, and the member and the counterpart body are configured to surround the protrusion. By this configuration, it is not practical to make the width of the main body greater than the width of the counterpart body, and as a result the main body lacks rigidity, which in turn causes a lack of stability in the support for the audio equipment. The configuration described in JP 2012-23538 thus suffers from a drawback in that sound quality of the audio equipment is subject to deterioration due to insufficient suppression of vibration.

In consideration of the above circumstances, an object of the present disclosure is to enhance sound quality of audio equipment.

In order to solve the above problem, an audio equipment support according to an aspect of the present disclosure includes a main body including a protrusion and being configured to be attachable to an audio equipment housing; a counterpart body including an outer edge and a recess contacting the protrusion, the outer edge of the counterpart body being positioned inward of an outer edge of the main body when viewed from a direction in which the protrusion and the recess are aligned; and a restriction member fixed to the main body and spaced apart from the counterpart body, the restriction member including a through-hole through which the counterpart body passes and being configured to restrict a distance between the main body and the counterpart body from reaching or exceeding a predetermined length.

An audio equipment support according to another aspect of the present disclosure includes a main body including a recess and being configured to be attachable to an audio equipment housing; a counterpart body including an outer edge and a protrusion contacting the recess, the outer edge of the counterpart body being positioned inward of an outer edge of the main body when viewed from a direction in which the protrusion and the recess are aligned; and a restriction member fixed to the main body and spaced apart from the counterpart body, the restriction member including a through-hole through which the counterpart body passes and being configured to restrict a distance between the main body and the counterpart body from reaching or exceeding a predetermined length.

Audio equipment according to an aspect of the present disclosure includes the audio equipment support according to any one of the above aspects.

DESCRIPTION OF THE EMBODIMENTS

1. Audio Equipment Support

First Embodiment

Figure 1:
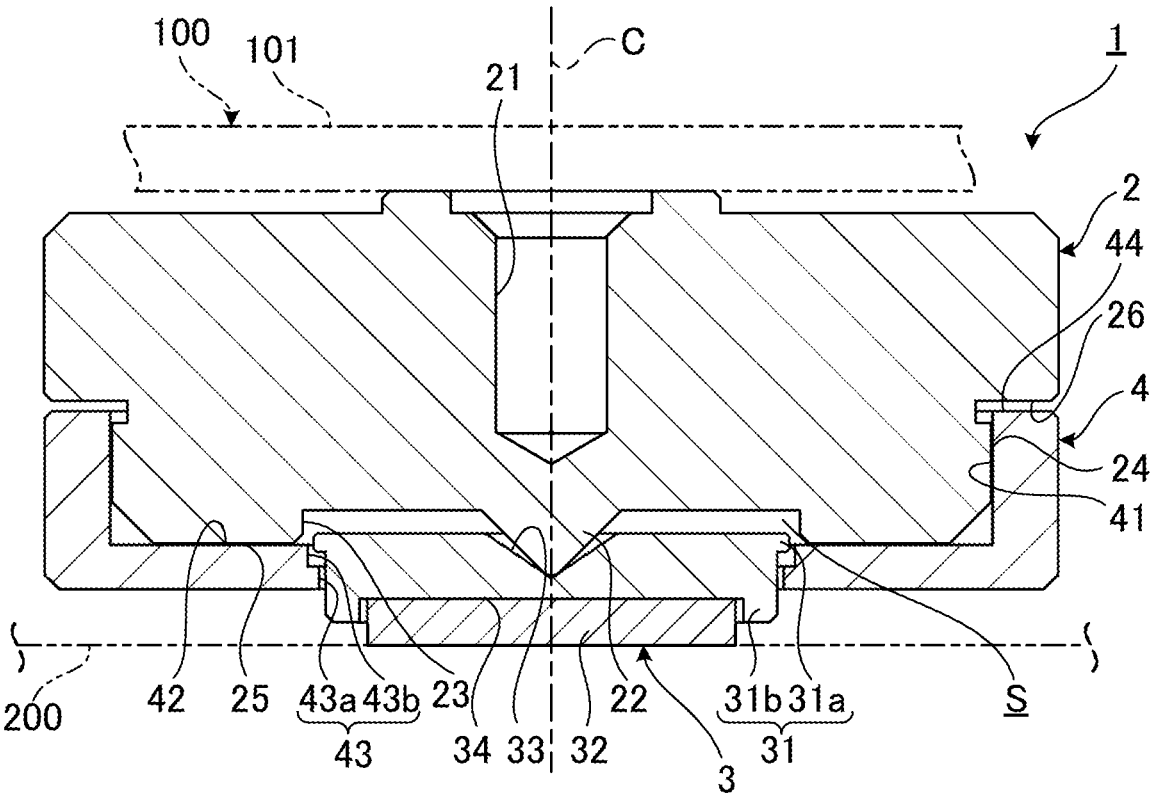
FIG. 1 is a cross-sectional view of an audio equipment support according to a first embodiment.

FIG. 1 is a cross-sectional view of an audio equipment support 1 according to a first embodiment. The audio equipment support 1 supports a housing 101 of audio equipment 100 by being positioned between the housing 101 and a mounting surface 200. The audio equipment 100 may be any audio equipment of a stationary type. The audio equipment 100 may be, for example, a disc player, an audio amplifier, a speaker, or the like. The disc player may be, for example, a compact disc (CD) player, a digital versatile disc (DVD) player, or the like. The mounting surface 200 may be any type of surface that the audio equipment 100 can be mounted on.

The audio equipment support 1 serves to suppress transmission of vibration between the housing 101 and the mounting surface 200 in addition to supporting the housing 101. The audio equipment support 1 thus configured enhances sound quality of the audio equipment 100. The audio equipment support 1 includes a main body 2 attached to the housing 101, a counterpart body 3 placed on the mounting surface 200, and a restriction member 4 that restricts a distance between the main body 2 and the counterpart body 3 from exceeding a predetermined length.

Figure 2:
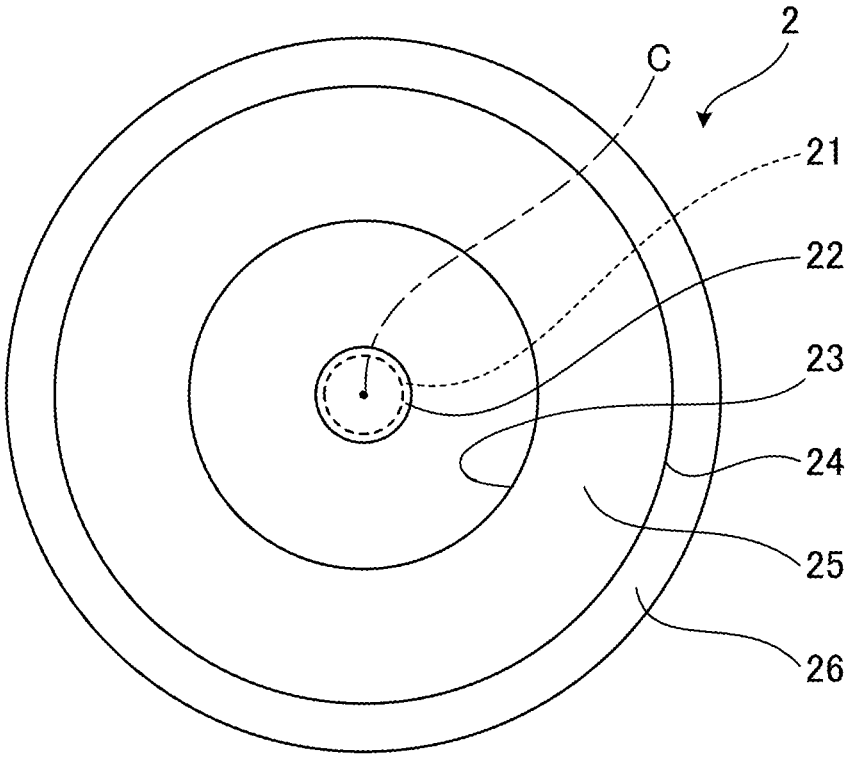
FIG. 2 is a plan view of a main body in the first embodiment viewed from below.
Figure 3:
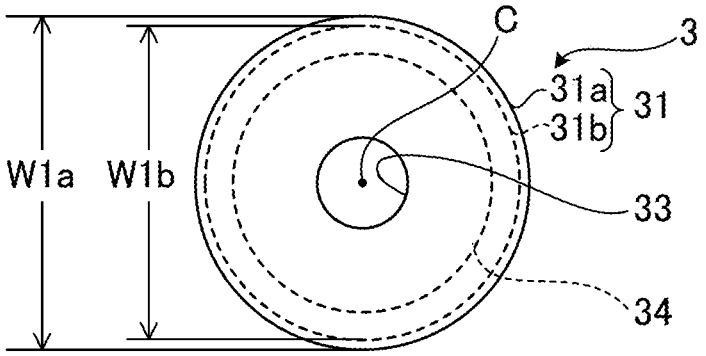
FIG. 3 is a plan view of a counterpart body in the first embodiment viewed from above.
Figure 4:
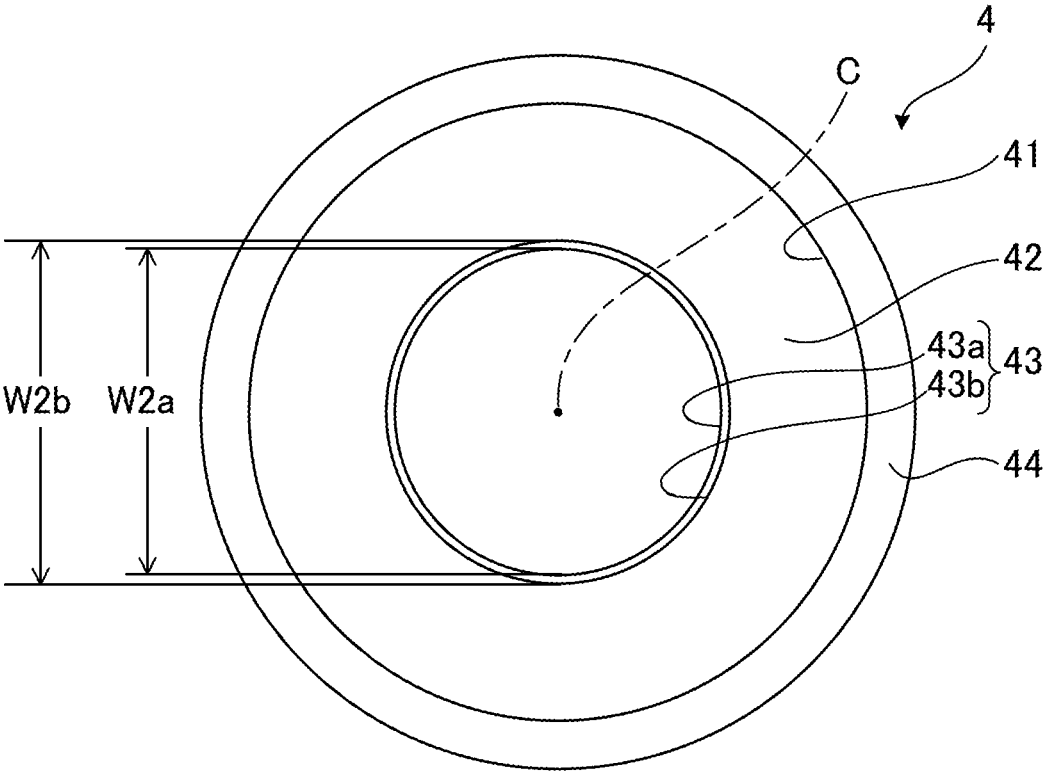
FIG. 4 is a plan view of a restriction member in the first embodiment viewed from above.

FIG. 2 is a plan view of the main body 2 viewed from below. FIG. 3 is a plan view of the counterpart body 3 viewed from above. FIG. 4 is a plan view of the restriction member 4 viewed from above. Hereafter, each part of the audio equipment support 1 will be sequentially described in detail with reference to FIGS. 1 to 4.

The main body 2 includes a spike. As illustrated in FIG. 1, the main body 2 has a substantially flat shape. As illustrated in FIG. 2, the main body 2 has a circular shape centered on an axis C. The shape of the main body 2 in a plan view is not limited to a circular shape, and may be, for example, a polygon such as a quadrangle.

A screw hole 21 is provided on an upper surface of the main body 2 as shown in FIG. 1. A recess 23 that is also circular in shape is provided on the other, lower surface of the main body 2. A protrusion 22 is provided further inward than the recess 23, on the same surface of the main body 2, and is centered on the axis C. An external thread 24 is provided on a side surface of the main body 2 in the lower region thereof as shown in FIG. 1.

The screw hole 21 is used to attach the main body 2 to the housing 101. In the main body 2, the screw hole 21 opens to an opposing side of a surface that faces the counterpart body 3. Thus, when an external thread (not illustrated) is fitted into the screw hole 21, the main body 2 is attached to the housing 101. The length of the external thread can be appropriately selected depending on a configuration of the housing 101. In this way, the audio equipment support 1 is rendered highly versatile. As illustrated in FIGS. 1 and 2, the screw hole 21 is centered on the axis C. Therefore, the main body 2 can be easily screwed onto the housing 101 by rotating the main body 2. The position of the screw hole 21 is not limited to the example illustrated in FIGS. 1 and 2, may be moved from the axis C.

As illustrated in FIG. 1, the protrusion 22 protrudes downward along the axis C. As illustrated in FIGS. 1 and 2, the protrusion 22 has a conical shape. Therefore, the protrusion 22 and the counterpart body 3 can be brought into contact with each other substantially at a single point. As a result, the transmission of vibration between the main body 2 and the counterpart body 3 can be more effectively suppressed as compared to a configuration in which the protrusion 22 and the counterpart body 3 are in overall surface contact with each other. The apex angle of the protrusion 22 is determined such that the protrusion 22 is in contact with the counterpart body 3 substantially at a single point. Specifically, the apex angle may be, for example, 60° or more and 140° or less, although the degree of the angle it is not limited thereto. The surface at the distal end of the protrusion 22 may be curved.

As illustrated in FIG. 2, the recess 23 has a shape that surrounds the protrusion 22 as seen in plan view. As illustrated in FIG. 1, the recess 23 forms a gap S between the main body 2 and the counterpart body 3. The gap S serves as clearance and prevents the main body 2 and the counterpart body 3 from coining into contact with each other.

The bottom surface of the recess 23 is flat, and the outer edge of the recess 23 is positioned outward of the counterpart body 3 as seen in plan view. As described above, the protrusion 22 protrudes from the bottom surface of the recess 23, with the bottom surface being a flat surface (first surface) of the main body 2 that faces the counterpart body 3. The outer edge of the first surface is positioned further outward than the outer edge of the counterpart body 3 when viewed from a direction in which the main body 2 and the counterpart body 3 are aligned. Due to inclusion of the first surface in the main body 2, rigidity in an area around the protrusion 22 of the main body 2 is increased. In other words, increased robustness is imparted to the structure in the area around the protrusion 22 of the main body 2. Accordingly, vibration of the protrusion 22 is suppressed, and the sound quality of the audio equipment 100 is enhanced.

The external thread 24 is centered on the axis C and is fitted into an internal thread 41 of the restriction member 4 described below.

A material used to form the main body 2 may be, for example, a metal material or a ceramic material, although the material is not limited thereto. The metal material may be, for example, aluminum, copper, titanium, iron, stainless steel, brass, or the like. The ceramic material may be, for example, alumina or the like. The main body 2 may comprise a dense body or a porous body. In some embodiments, the material used to form the main body 2 may have a density of 8 or more and a Vickers hardness HV of 40 or more and 80 or less. When the density and the Vickers hardness HV of a material that forms the main body 2 are within these ranges, the main body 2 is prevented from readily vibrating, and a necessary mechanical strength of the main body 2 is secured. As a result, the sound quality of the audio equipment 100 is enhanced. A method of manufacture of the main body 2 may be freely selected. For example, cutting, metal powder injection molding, metal powder metallurgy, casting, press processing, and the like can be exemplified as a method of manufacture of the main body 2.

The counterpart body 3 is a saucer that is in contact with the protrusion 22. The counterpart body 3 includes a receiving member 31 and an elastic member 32. The receiving member 31 is substantially a plate shape. As illustrated in FIG. 3, the receiving member 31 has a circular shape in plan view. The receiving member 31 has a first portion 31*a* with a width W1*a* and a second portion 31*b* with a width W1*b* that is smaller than the width W1*a*. The first portion 31*a* is closer than the second portion 31*b* to the main body 2. The shape of the receiving member 31 in plan view is not limited to a circular shape, and may be, for example, a polygon such as a quadrangle.

A recess 33 is provided on one surface on an upper side of the receiving member 31, as shown in FIG. 1. A recess 34 is provided on the other, lower surface of the receiving member 31 as shown in FIG. 1.

As illustrated in FIGS. 1 and 3, the recess 33 has a conical shape. The apex angle of the recess 33 is greater than that of the protrusion 22. Therefore, the distal end of the protrusion 22 is in contact with the recess 33 substantially at a single point, which is a contact point between the apexes of the protrusion 22 and the recess 33. Consequently, the counterpart body 3 is positioned relative to the main body 2 in a direction perpendicular to the axis C. The apex angle of the recess 33 may be, for example, 70° or more and 150° or less, although the degree of the angle is not limited thereto. The depth of the recess 33 is smaller than the height of the protrusion 22, whereby contact at a single point can be realized. The shape of the recess 33 is not limited to one that is conical and may be, for example, a hemispherical shape.

The recess 34 has a flat bottom surface. The elastic member 32 having elasticity is arranged on the bottom surface of the recess 34. The elastic member 32 is joined to the receiving member 31 using an adhesive (not shown). By being interposed between the receiving member 31 and the mounting surface 200, the elastic member 32 absorbs vibration therebetween. Therefore, an improvement in vibration absorption in the audio equipment support 1 is attained compared to a configuration in which the elastic member 32 is not provided. Also, since the elastic member 32 causes an increase in a frictional force that acts between the counterpart body 3 and the mounting surface 200, positional deviation of the receiving member 31 is restrained. In the example illustrated in FIG. 1, the elastic member 32 has a plate shape or a sheet shape. The thickness of the elastic member 32 is greater than the depth of the recess 34. Therefore, contact is prevented from occurring between the receiving member 31 and the mounting surface 200. A material from which the elastic member 32 is formed may be freely selected. For example, a felt, a rubber material, and an elastomeric material can be exemplified as the constituent material of the elastic member 32.

A material from which the receiving member 31 is formed may be the same as that of the main body 2. In some embodiments, the material used to form the receiving member 31 may differ from that used to form the main body 2. It is of note that when different materials are used, the Vickers hardness HV of the material used to form the receiving member 31 is higher than that of the main body 2. As a result of this relationship in the Vickers hardness HV, abrasion or the like of the receiving member 31 can be reduced. A method of manufacture of the receiving member 31 may be freely selected. For example, cutting, metal powder injection molding, metal powder metallurgy, casting, press processing, or the like may be adopted.

The restriction member 4 is spaced apart from the counterpart body 3 when the main body 2 and the counterpart body 3 are in contact with each other. The restriction member 4 restricts the distance between the main body 2 and the counterpart body 3 from reaching or exceeding a predetermined length. The restriction member 4 is a cover. As illustrated in FIGS. 1 and 4, the restriction member 4 has a cylindrical shape that in FIG. 1 opens upward at one end, with the opposing end forming the bottom of the restriction member 4. The internal thread 41 is provided on an inner circumferential surface of the restriction member 4. A through-hole 43 that penetrates along the direction of the axis C is provided at the bottom of the restriction member 4. The inner surface of a portion where there is no hole in the bottom comprises a bottom surface 42.

The internal thread 41 is fitted to the external thread 24 of the main body 2. Consequently, the restriction member 4 is fixed to the main body 2 such that the bottom surface 42 of the restriction member 4 comes into contact with a lower surface 25 of the main body 2, as shown in FIG. 1. The fixed state is maintained by a frictional force that acts under the contact. As described above, the main body 2 has an outer circumferential surface on which the external thread 24 is provided, and the restriction member 4 has an inner circumferential surface on which the internal thread 41 fitted to the outer circumferential surface of the main body 2 is provided. By use of this configuration, the number of parts of the audio equipment support 1 can be reduced compared to a configuration in which the main body 2 and the restriction member 4 are screwed and fixed together using separate screws. Further, the main body 2 and the restriction member 4 can be fixed to each other by a simple operation of rotating the main body 2 and the restriction member 4 relative to each other.

The end surface 44 of the restriction member 4 on the upper side thereof as shown in FIG. 1 is spaced apart from a stepped surface 26 of the main body 2, but may instead be in contact with the stepped surface 26. Moreover, since the bottom surface 42 of the restriction member 4 is in contact with the surface 25 of the main body 2, a contact area between the main body 2 and the restriction member 4 can be increased compared to a configuration in which the end surface 44 is in contact with the stepped surface 26. In this way, the main body 2 and the restriction member 4 are more firmly integrated, and as a result, an advantage is obtained in that vibration of the audio equipment support 1 can be efficiently suppressed.

The through-hole 43 is a hole through which the counterpart body 3 passes. The second portion 31*b* of the receiving member 31 passes through the through-hole 43, whereas the first portion 31*a* does not. As illustrated in FIGS. 1 and 4, the through-hole 43 and the receiving member 31 are similar in shape. That is, they are each of a circular shape centered on the axis C in plan view.

As illustrated in FIG. 4, the through-hole 43 has a first portion 43*a* having a width W2*a* and a second portion 43*b* having a width W2*b*, which is greater than the width W2*a*. The width (diameter) of the through-hole 43 in a portion corresponding to the first portion 43*a* with the width W2*a* is greater than the width W1*b* of the second portion 31*b* of the receiving member 31. Accordingly, when the protrusion 22 and the recess 33 are in contact with each other, with the axis of the protrusion 22 corresponding to the axis of the recess 33, the second portion 31*b* and the first portion 43*a* can be brought into a state in which they are spaced apart from each other in a direction perpendicular to the axis C. The width W2*a* of the first portion 43*a* is smaller than the width W1*a* of the first portion 31*a* of the receiving member 31. Accordingly, the distance between the main body 2 and the counterpart body 3 is restricted from reaching or exceeding a predetermined length. The width W2*b* of the second portion 43*b* is greater than the width W1*a* of the first portion 31*a* of the receiving member 31. Accordingly, in a state in which the protrusion 22 and the recess 33 are in contact with each other, with the axis of the protrusion 22 corresponding to the axis of the recess 33, the first portion 31*a* and the second portion 43*b* can be brought into a state in which they are spaced apart from each other in a direction perpendicular to the axis C. In a state in which the protrusion 22 and the recess 33 are in contact with each other, with the axis of the protrusion 22 corresponding to the axis of the recess 33, the second portion 43*b* brings the first portion 31*a* and the first portion 43*a* into a state in which they are spaced apart from each other in a direction along the axis C.

The same material used to form the main body 2 can be used to form the restriction member 4. In some embodiments, the material that forms the restriction member 4 may be different from the material that forms the main body 2. A method of manufacture of the restriction member 4 may be freely selected. For example, cutting, metal powder injection molding, metal powder metallurgy, casting, press processing, or the like may be adopted as the method of manufacture of the restriction member 4.

According to the audio equipment support 1, the restriction member 4, which restricts the distance between the main body 2 and the counterpart body 3 from reaching or exceeding a predetermined length, is fixed to the main body 2. Also, as illustrated in FIG. 1, the outer edge of the counterpart body 3 is positioned further inward than an outer edge of the main body 2 when viewed from a direction in which the protrusion 22 and the recess 33 are aligned. Therefore, the width of the main body 2 can be made greater than that of the counterpart body 3. As a result, compared to a configuration in which the width of the main body 2 is smaller than that of the counterpart body 3, a rigidity the main body 2 can be increased, and a stability of support of the housing 101 by the audio equipment support 1 also can be increased. Here, the counterpart body 3 partially passes through the through-hole 43 of the restriction member 4. Accordingly, the counterpart body 3 can be installed on the mounting surface 200. The restriction member 4 and the counterpart body 3 are spaced apart from each other such that the main body 2 and the counterpart body 3 are in contact with each other. Therefore, the transmission paths of vibration between the main body 2 and the counterpart body 3 can be reduced compared to a configuration in which the restriction member 4 and the counterpart body 3 are in contact with each other, when the main body 2 and the counterpart body 3 are in contact with each other. As a result, it is possible to prevent vibration from being readily transmitted between the main body 2 and the counterpart body 3. As described above, according to the audio equipment support 1, a quality of sound emitted from the audio equipment 100 can be enhanced.

Second Embodiment

A second embodiment will now be described. In each configuration exemplified below, elements whose actions and functions are the same as those in the first embodiment will be denoted by the same reference signs used in the description of the first embodiment, and detailed description thereof will be omitted as appropriate.

Figure 5:
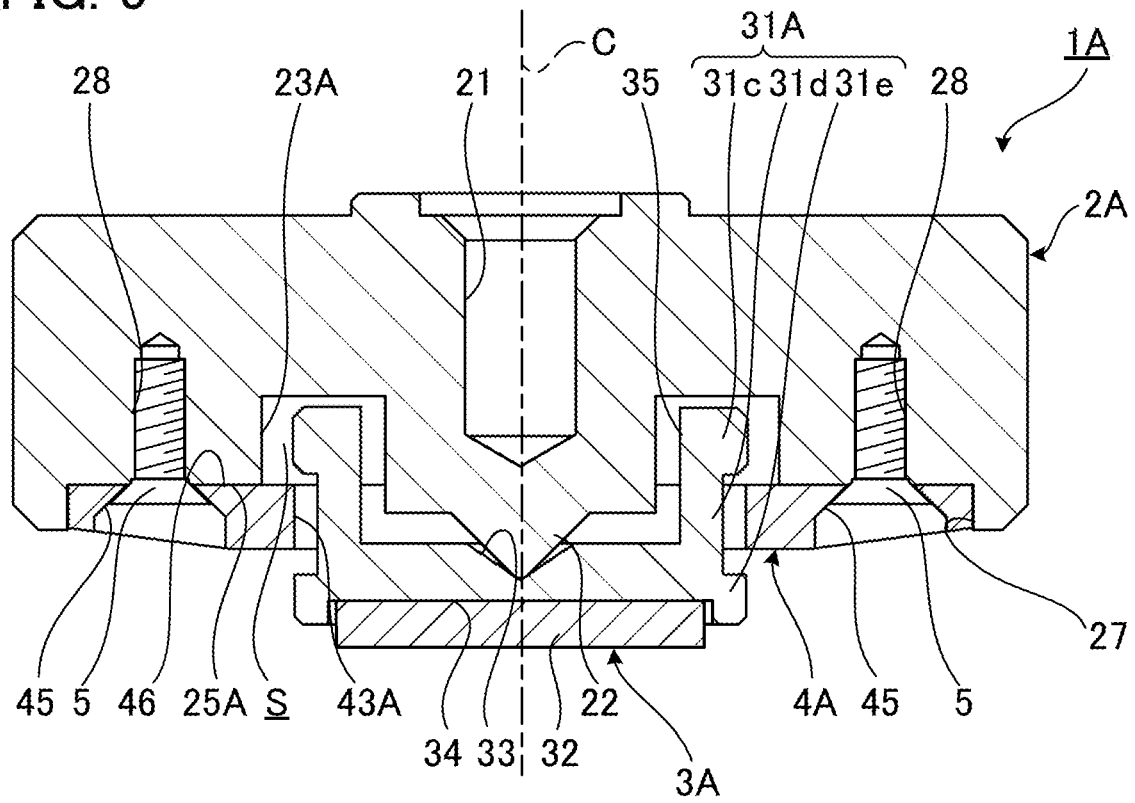
FIG. 5 is a cross-sectional view of an audio equipment support according to a second embodiment.

FIG. 5 is a cross-sectional view of an audio equipment support 1A according to the second embodiment. The audio equipment support 1A includes a main body 2A, a counterpart body 3A, and a restriction member 4A. The counterpart body 3A is fixed to the main body 2A by screws 5.

Specifically, an annular recess 23A which accommodates a portion of the counterpart body 3A, a recess 27 in which the restriction member 4A is disposed, and screw holes 28 into which the screws 5 are fitted are provided on a lower surface of the main body 2A, as shown in FIG. 5.

The counterpart body 3A includes a receiving member 31A and an elastic member 32. The receiving member 31A and the elastic member 32 are adhered to each other. The receiving member 31A includes a first portion 31*c*, a second portion 31*d*, and a third portion 31*e*, that are aligned in the order listed from an upper side to a lower side in FIG. 5. The width of the first portion 31*c* and the width of the third portion 31*e* are each greater than the width of the second portion 31*d*. The first portion 31*c* is disposed in the recess 23A. An external thread centered on an axis C is provided on an outer circumferential surface of the first portion 31*c*.

The restriction member 4A has a plate shape. A bottom surface 25A of the recess 27 is in contact with a surface 46, which is an upper surface among the surfaces of the restriction member 4A in FIG. 5. A through-hole 43A through which the counterpart body 3A passes, and holes 45 are provided in the restriction member 4A. A screw 5 passes through each of the holes 45. The second portion 31*d* of the counterpart body 3A passes through the through-hole 43A. The width of the through-hole 43A is greater than a width of the second portion 31*d*. Therefore, the counterpart body 3A and the restriction member 4A are prevented from coining into contact with each other. The width of the through-hole 43A is smaller than that of the first portion 31*c*. Therefore, the distance between the main body 2A and the counterpart body 3A is prevented from reaching or exceeding a predetermined amount. There is provided on the inner circumferential surface of the through-hole 43A an internal thread for receiving an external thread in the first portion 31*c*.

The audio equipment support 1A includes the screws 5 for fixing the main body 2A and the restriction member 4A to each other. Accordingly, compared to a configuration in which the main body 2A and the restriction member 4A are fixed to each other by a single screw, the main body 2A and the restriction member 4A are more firmly integrated, and vibration of the audio equipment support 1A is reduced.

The internal thread is provided on the inner circumferential surface of the through-hole 43A of the restriction member 4A, and the external thread that can be fitted into the internal thread of the through-hole 43A is provided on the outer circumferential surface of the counterpart body 3A. Therefore, the counterpart body 3A can be fitted into the through-hole 43A of the restriction member 4A and penetrate the length of the through-hole 43A. As a result, the audio equipment support 1A can be assembled with the counterpart body 3A penetrating the length of the through-hole 43A of the restriction member 4A after the restriction member 4A is fixed to the main body 2A.

Third Embodiment

A third embodiment will now be described. In each configuration exemplified below, elements whose actions and functions are the same as those in the first embodiment will be denoted by the same reference signs used in the description of the first embodiment, and detailed description thereof will be omitted as appropriate.

Figure 6:
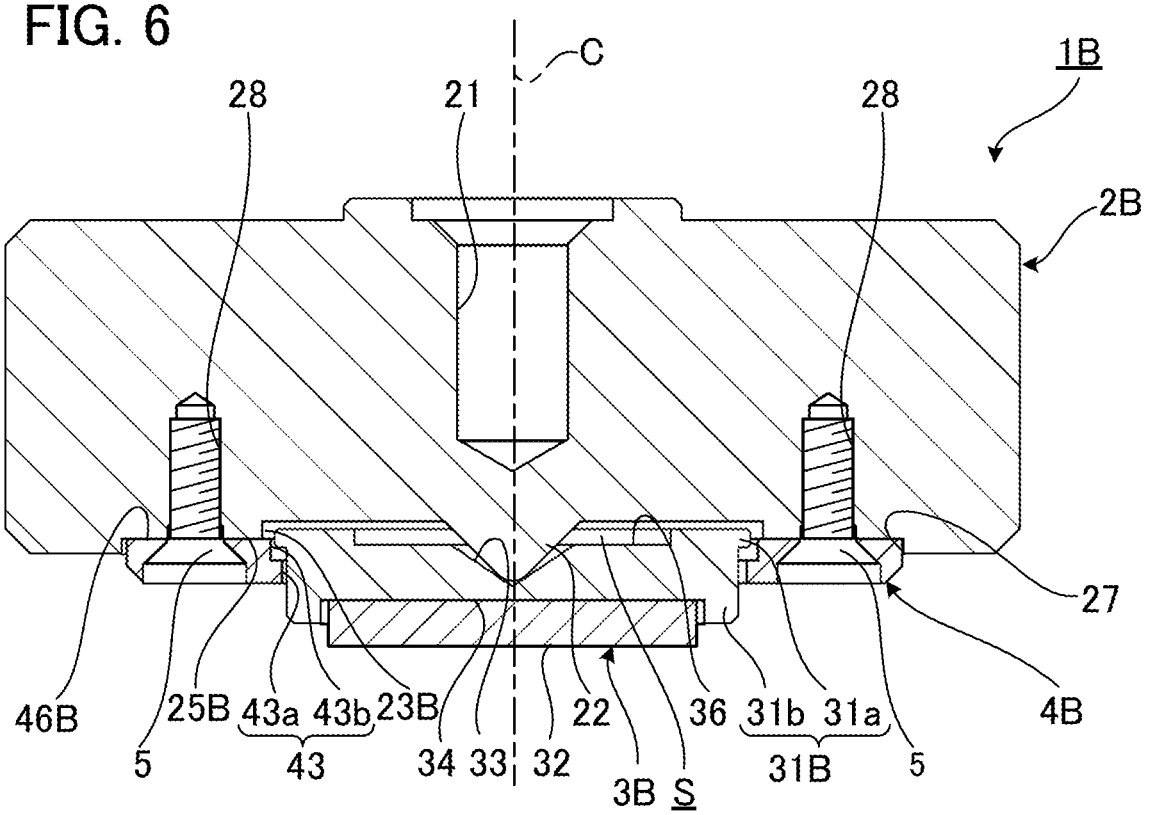
FIG. 6 is a cross-sectional view of an audio equipment support according to a third embodiment.

FIG. 6 is a cross-sectional view of an audio equipment support 1B according to the third embodiment. The audio equipment support 1B includes a main body 2B, a counterpart body 3B, and a restriction member 4B. Similarly to the second embodiment, the counterpart body 3B is fixed to the main body 2B by use of screws 5.

Specifically, instead of the recess 23A of the second embodiment, there is provided a recess 23B having a depth smaller than that of the recess 23A on a lower surface of the main body 2B, as shown in FIG. 6.

The counterpart body 3B includes a receiving member 31B and an elastic member 32. The receiving member 31B and the elastic member 32 are joined to each other by adhesion. The receiving member 31B includes the same first portion 31*a* and second portion 31*b* as those in the first embodiment. A recess 36 is provided on an upper surface of the receiving member 31B as shown in FIG. 6.

The restriction member 4B has a plate shape. A bottom surface 25B of the recess 27 is in contact with an upper surface 46B of the restriction member 4B in FIG. 6. There are provided in the restriction member 4B a through-hole 43, through which the counterpart body 3B passes, and holes 45. Each screw 5 passes through a corresponding hole 45.

Modifications

The present disclosure is not limited to the embodiments described above, and various modifications described below can be made. Also, the embodiments and the modifications can be combined as appropriate.

Figure 7:
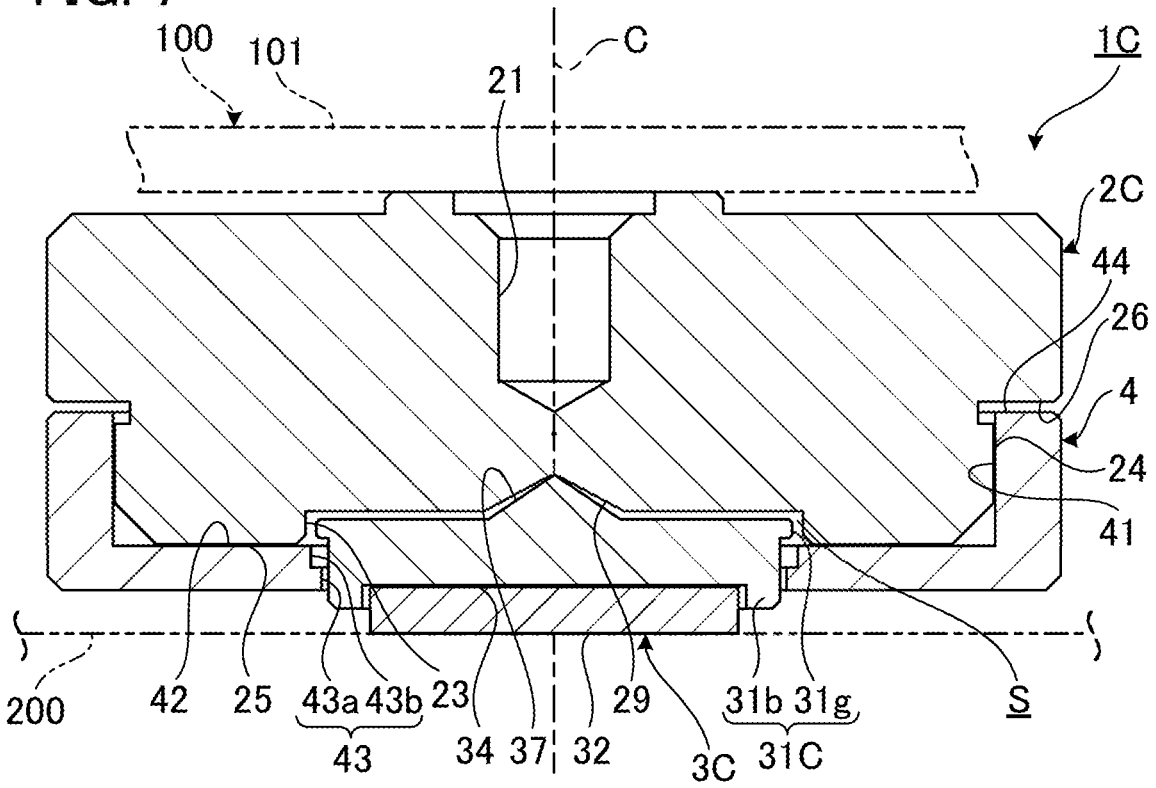
FIG. 7 is a cross-sectional view of an audio equipment support according to a modification.

In the configuration described above, the main body 2 includes the protrusion 22 and the counterpart body 3 includes the recess 33. Alternatively, as in the audio equipment support 1C illustrated in FIG. 7, a main body 2C may have a recess 29, and a counterpart body 3C may have a protrusion 37 that is in contact with the recess 29 at a single point. According to this configuration, the same effects as obtained in the above-described embodiment can be obtained.

In the configuration described above, the protrusion 22 has a conical shape. However, the protrusion 22 is not limited thereto; for example, the protrusion 22 may have a hemispherical shape.

In the configuration described above, the main body and the counterpart body are in contact with each other at substantially a single point. However, the main body and the counterpart body may be in contact with each other in any other manner as long as transmission of vibration therebetween can be suppressed. For example, the main body and the counterpart body may be substantially in line contact with each other.

Figure 8:
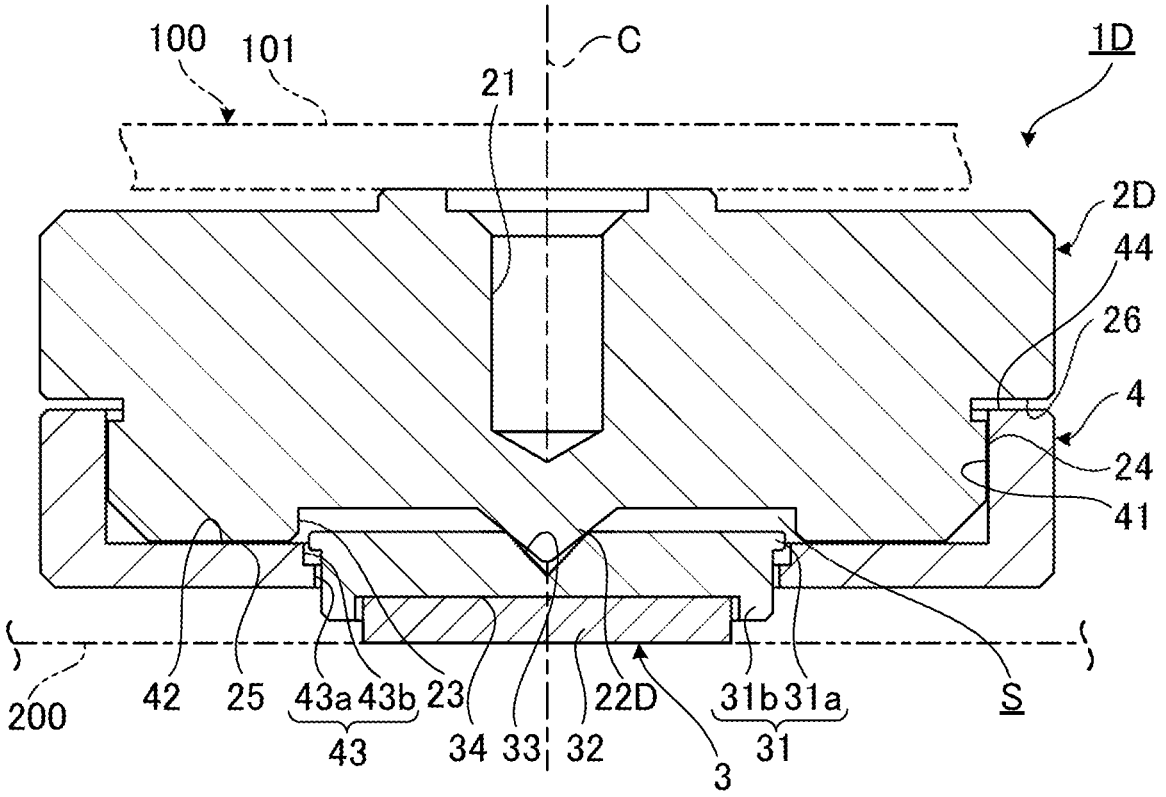
FIG. 8 is a cross-sectional view of an audio equipment support according to a modification.

This configuration can be realized, for example, in a case in which the apex angle of the protrusion 22 in relation to that of the recess 33 is reversed from that described in the above embodiments. Alternatively, the shape of the protrusion 22 may be hemispherical or columnar. FIG. 8 shows as an example such an audio equipment support 1D, in which the main body 2D and the counterpart body 3 can be brought into line contact with each other in a configuration in which the apex angle of a protrusion 22D of a main body 2D is greater than the apex angle of the recess 33 of the counterpart body 3.

In the configuration described above, the main body and the restriction member are fixed to each other by a screw structure that is provided on the main body and the restriction member or by screws that are separate from both the main body and the restriction member. However, the fixing method is not limited to the configuration described above. For example, the main body and the restriction member may be interfittingly fixed to each other.

2. Audio Equipment

Figure 9:
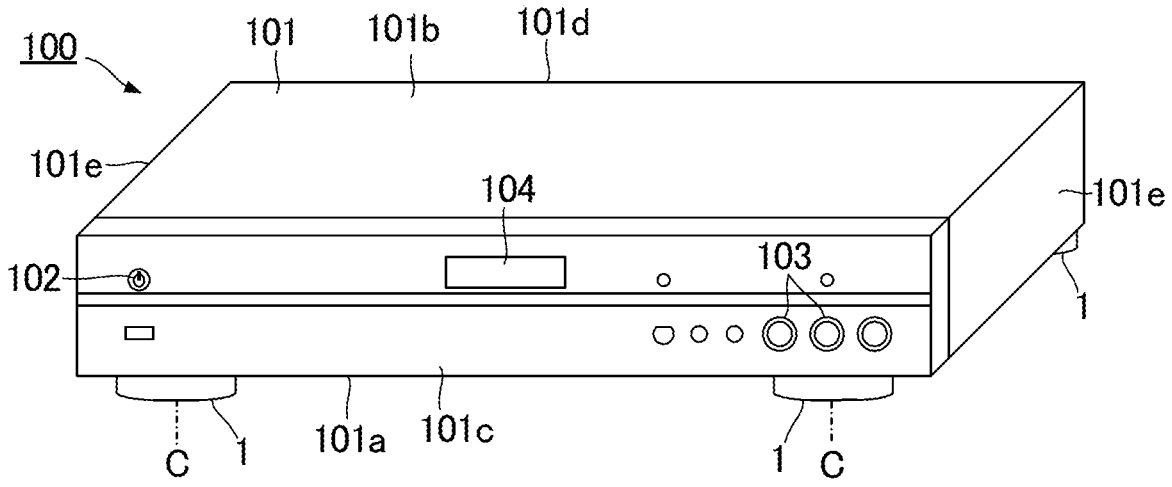
FIG. 9 is a perspective view illustrating an example of audio equipment according to the embodiments.

FIG. 9 is a perspective view illustrating an example of the audio equipment 100 according to an embodiment. The audio equipment 100 illustrated in FIG. 9 may consist of equipment such as an audio amplifier. The audio equipment 100 includes a housing 101 and audio equipment supports 1 attached to the housing 101. The housing 101 is of a box shape, and is comprised of a bottom plate 101*a*, a top plate 101*b*, a front surface panel 101*c*, a rear surface panel 101*d*, and left and right side plates 101*e*. The top plate 101*b* and the left and right side plates 101*e* are unitarily configured. The front surface panel 101*c*, the rear surface panel 101*d*, and the left and right side plates 101*e* are fixed to the bottom plate 101*a* by use of a screw or the like.

A power switch 102, an operation switch 103, a display 104, and the like are arranged on the front surface panel 101*c*. Terminals such as an input terminal and an output terminal (not illustrated) are arranged on the rear surface panel 101*d*. Electric circuitry and the like (not illustrated) are fixed on an upper surface of the bottom plate 101*a* such that the electric circuitry and the like are accommodated in the housing 101. Also, the audio equipment supports 1 are attached to a lower surface of the bottom plate 101*a* and serve as support legs for the housing 101. FIG. 9 shows a configuration in which the audio equipment supports 1 according to the first embodiment are respectively attached to vicinities of the four corners of the bottom plate 101*a*. The number of audio equipment supports attached to the housing 101 is not limited to four, and may be, for example, three or five or more. Also, the audio equipment supports 1A, 1B, 1C, or 1D of the second embodiment, third embodiment, or the modification may be used in place of the audio equipment supports 1.

From the configurations exemplified above, for example, the following aspects are derivable.

An audio equipment support according to an aspect of the present disclosure includes a main body including a protrusion and being configured to be attachable to an audio equipment housing, a counterpart body including an outer edge and a recess contacting the protrusion, the outer edge of the counterpart body being positioned inward of an outer edge of the main body when viewed from a direction in which the protrusion and the recess are aligned, and a restriction member fixed to the main body and spaced apart from the counterpart body, the restriction member including a through-hole through which the counterpart body passes and being configured to restrict a distance between the main body and the counterpart body from reaching or exceeding a predetermined length. In the above aspect, the restriction member, which restricts the distance between the main body and the counterpart body from reaching or exceeding a predetermined length, is fixed to the main body. The outer edge of the counterpart body is positioned further inward than the outer edge of the main body when viewed from a direction in which the protrusion and the recess are aligned. Therefore, the width of the main body can be made greater than that of the counterpart body. As a result, compared to a configuration in which the width of the main body is smaller than that of the counterpart body, the main body can be made more rigid and the housing can be supported by the audio equipment support in a more stable manner. Here, since the counterpart body passes through the through-hole of the restriction member, the counterpart body can be installed on the mounting surface. Furthermore, the restriction member and the counterpart body are spaced apart from each other in a state in which the main body and the counterpart body are in contact with each other. Accordingly, the transmission paths of vibration between the main body and the counterpart body can be reduced compared to a configuration in which the restriction member and the counterpart body are in contact with each other, and the main body and counterpart body are in contact with each other. As a result, it is possible to prevent vibration from being readily transmitted between the main body and the counterpart body. As described above, according to the audio equipment support of the present aspect, the sound quality of the audio equipment can be enhanced.

An audio equipment support according to another aspect of the present disclosure includes a main body including a recess and being configured to be attachable to an audio equipment housing, a counterpart body including an outer edge and a protrusion contacting the recess, the outer edge of the counterpart body being positioned inward of an outer edge of the main body when viewed from a direction in which the protrusion and the recess are aligned, and a restriction member fixed to the main body and spaced apart from the counterpart body, the restriction member including a through-hole through which the counterpart body passes and being configured to restrict a distance between the main body and the counterpart body from reaching or exceeding a predetermined length. In the present aspect, the sound quality of the audio equipment can be enhanced as in the above-described aspect.

In an example of the above-described aspect, the protrusion has a conical shape. According to the present aspect, the protrusion and the recess can be brought into contact at substantially a single point. Therefore, the transmission of vibration between the main body and the counterpart body can be reduced compared to a configuration in which the protrusion and the recess are in surface contact with each other.

In an example of the above-described aspect, the protrusion protrudes from a flat surface of the main body and faces the counterpart body, and an outer edge of the flat surface of the main body is positioned outward of the outer edge of the counterpart body when viewed from a direction in which the main body and the counterpart body are aligned. According to the present aspect, the rigidity of a portion around the protrusion, of the main body, can be enhanced.

In an example of the above-described aspect, the main body includes an outer circumferential surface on which an external thread is arranged, and the restriction member includes an inner circumferential surface on which an internal thread is arranged, the internal thread of the inner circumferential surface of the restriction member being threadedly engaged with the external thread of the outer circumferential surface of the main body. According to the present aspect, a contact area between the main body and the restriction member can be increased, whereby the main body and the restriction member are more firmly integrated, and needless vibration of the audio equipment support can be reduced. Also, the number of parts of the audio equipment support can be reduced compared to a configuration in which the main body and the restriction member are screwed and fixed using separate screws. Further, the main body and the restriction member can be fixed to each other by a simple operation of rotating the main body and the restriction member relative to each other.

In an example of the above-described aspect, screws that fix the main body and the restriction member to each other. According to the present aspect, compared to a configuration in which the main body and the restriction member are fixed to each other by one screw, the main body and the restriction member are more firmly integrated, and needless vibration of the audio equipment support can be reduced.

In an example of the above-described aspect, the main body includes a fastener hole in a surface of the main body that is arranged on an opposite side of the main body from another surface of the main body that faces the counterpart body. According to the present aspect, the main body can be attached to the housing of the audio equipment by fitting the external thread into the screw hole of the main body. The length of the external thread can be appropriately selected depending on a configuration of the housing to be attached. Therefore, the audio equipment support is rendered highly versatile.

In an example of the above-described aspect, an internal thread is arranged on an inner circumferential surface of the through-hole, and an external thread is arranged on an outer circumferential surface of the counterpart body, the external thread of the outer circumferential surface of the counterpart body being configured to threadedly engage with the internal thread of the inner circumferential surface of the through-hole. According to the present aspect, the counterpart body can be fitted into the through-hole of the restriction member, with the counterpart body penetrating the through-hole. As a result, the audio equipment support can be assembled with the counterpart body penetrating the through-hole of the restriction member after the restriction member is fixed to the main body.

In an example of the above-described aspect, the counterpart body includes an elastic member. According to the present aspect, a vibration-absorption ability of the audio equipment support can be improved compared to a configuration in which the elastic member is not provided.

The audio equipment according to an aspect of the present disclosure includes the audio equipment support of the above-described aspects. In the above aspects, the quality of sounds from the audio equipment can be enhanced.

DESCRIPTION OF REFERENCE SIGNS

1: Audio equipment support, 1A: Audio equipment support, 1B: Audio equipment support, 1C: Audio equipment support, 1D: Audio equipment support, 2: Main body, 2A: Main body, 2B: Main body, 2C: Main body, 2D: Main body, 3: Counterpart body, 3A: Counterpart body, 3B: Counterpart body, 3C: Counterpart body, 4: Restriction member, 4A: Restriction member, 4B: Restriction member, 5: Screw, 21: Screw hole, 22: Protrusion, 24: External thread, 29: Recess, 32: Elastic member, 37: Protrusion, 41: Internal thread, 43: Through-hole, 43A: Through-hole, 100: Audio equipment, 101: Housing, 200: Mounting surface.

What is claimed is:

1. An audio equipment support, comprising:

a main body including a protrusion and being configured to be attachable to an audio equipment housing;

a counterpart body including an outer edge and a recess contacting the protrusion, the outer edge of the counterpart body being positioned inward of an outer edge of the main body when viewed from a direction in which the protrusion and the recess are aligned; and a restriction member fixed to the main body and spaced apart from the counterpart body, the restriction member including a through-hole through which the counterpart body passes and being configured to restrict a distance between the main body and the counterpart body from reaching or exceeding a predetermined length.

2. The audio equipment support according to claim 1, wherein the protrusion has a conical shape.

3. The audio equipment support according to claim 1, wherein the protrusion protrudes from a flat surface of the main body and faces the counterpart body, and wherein an outer edge of the flat surface of the main body is positioned outward of the outer edge of the counterpart body when viewed from a direction in which the main body and the counterpart body are aligned.

4. The audio equipment support according to claim 1, wherein the main body includes an outer circumferential surface on which an external thread is arranged, and wherein the restriction member includes an inner circumferential surface on which an internal thread is arranged, the internal thread of the inner circumferential surface of the restriction member being threadedly engaged with the external thread of the outer circumferential surface of the main body.

5. The audio equipment support according to claim 1, further comprising screws that fix the main body and the restriction member to each other.

6. The audio equipment support according to claim 1, wherein the main body includes a fastener hole in a surface of the main body that is arranged on an opposite side of the main body from another surface of the main body that faces the counterpart body.

7. The audio equipment support according to claim 1, wherein an internal thread is arranged on an inner circumferential surface of the through-hole, and wherein an external thread is arranged on an outer circumferential surface of the counterpart body, the external thread of the outer circumferential surface of the counterpart body being configured to threadedly engage with the internal thread of the inner circumferential surface of the through-hole.

8. The audio equipment support according to claim 1, wherein the counterpart body includes an elastic member.

9. An audio equipment support comprising:

a main body including a recess and being configured to be attachable to an audio equipment housing;

a counterpart body including an outer edge and a protrusion contacting the recess, the outer edge of the counterpart body being positioned inward of an outer edge of the main body when viewed from a direction in which the protrusion and the recess are aligned; and a restriction member fixed to the main body and spaced apart from the counterpart body, the restriction member including a through-hole through which the counterpart body passes and being configured to restrict a distance between the main body and the counterpart body from reaching or exceeding a predetermined length.

10. The audio equipment support according to claim 9, wherein the protrusion has a conical shape.

11. The audio equipment support according to claim 9, wherein the recess is provided in a first surface, from among surfaces of the main body, that faces the counterpart body, and wherein an outer edge of the first surface is positioned outward of the outer edge of the counterpart body when viewed from a direction in which the main body and the counterpart body are aligned.

12. The audio equipment support according to claim 9, wherein the main body includes an outer circumferential surface on which an external thread is arranged, and wherein the restriction member includes an inner circumferential surface on which an internal thread is arranged, the internal thread of the inner circumferential surface of the restriction member being threadedly engaged with the external thread of the outer circumferential surface of the main body.

13. The audio equipment support according to claim 9, further comprising screws that fix the main body and the restriction member to each other.

14. The audio equipment support according to claim 9, wherein the main body includes a fastener hole in a surface of the main body that is arranged on an opposite side of the main body from another surface of the main body that faces the counterpart body.

15. The audio equipment support according to claim 9, wherein an internal thread is arranged on an inner circumferential surface of the through-hole, and wherein an external thread is arranged on an outer circumferential surface of the counterpart body, the external thread of the outer circumferential surface of the counterpart body being configured to threadedly engage with the internal thread of the inner circumferential surface of the through-hole.

16. The audio equipment support according to claim 9, wherein the counterpart body includes an elastic member.

17. An apparatus, comprising:

audio equipment including a housing; and an audio equipment support attached to the housing of the audio equipment, wherein the audio equipment support includes:

a main body attached to the housing of the audio equipment, the main body including a protrusion;

a counterpart body including an outer edge and a recess contacting the protrusion, the outer edge of the counterpart body being positioned inward of an outer edge of the main body when viewed from a direction in which the protrusion and the recess are aligned; and a restriction member fixed to the main body and spaced apart from the counterpart body, the restriction member including a through-hole through which the counterpart body passes and being configured to restrict a distance between the main body and the counterpart body from reaching or exceeding a predetermined length.

18. The audio equipment support according to claim 1, wherein the through-hole through which the counterpart body passes penetrates an entire thickness of the restriction member.

19. The audio equipment support according to claim 18, wherein the through-hole through which the counterpart body passes and that penetrates the entire thickness of the restriction member includes a first portion having a first diameter and a second portion having a second diameter different from the first diameter.

20. The audio equipment support according to claim 1, wherein the through-hole through which the counterpart body passes penetrates an entire thickness of the restriction member along the direction in which the protrusion and the recess are aligned.

* * * * *